US005679931A

United States Patent [19]

Furse et al.

[11] Patent Number: 5,679,931

[45] Date of Patent: Oct. 21, 1997

[54] SOUND ATTENUATING APPARATUS AND METHOD OF FORMING THE SAME

[75] Inventors: John H. Furse; Robert A. Noreen, both of Jefferson County, Ky.

[73] Assignee: AAF-International, Louisville, Ky.

[21] Appl. No.: 500,333

[22] Filed: Jul. 10, 1995

[51] Int. Cl.[6] ..... E04F 17/04

[52] U.S. Cl. ..... 181/224; 181/257; 181/275; 181/282

[58] Field of Search ..... 181/224, 210, 181/218, 284, 292, 293

[56] References Cited

U.S. PATENT DOCUMENTS 2,489,048 11/1949 Rinehart .
2,994,401 8/1961 Bourne et al. ..... 181/224
3,019,850 2/1962 March .
4,127,183 11/1978 McLarty .
4,236,597 12/1980 Kiss et al. ..... 181/224

FOREIGN PATENT DOCUMENTS 52-5455 5/1977 Japan ..... 181/224

*Primary Examiner*—Khanh Dang
*Attorney, Agent, or Firm*—Polster Lieder Woodruff & Lucchesi

[57] ABSTRACT

A sound attenuating apparatus and method for forming the same including stacking selectively sized sheets of sound attenuating materials and fastening the same to form elongated, perforated sound attenuating flow-through passages which are structurally connected by means of mechanical joinders outside the noise bearing fluid stream to be attenuated.

15 Claims, 4 Drawing Sheets

SOUND ATTENUATING APPARATUS AND METHOD OF FORMING THE SAME

BACKGROUND OF THE INVENTION

The present invention relates to sound attenuation of a noise bearing fluid stream and more particularly to a unique and novel sound attenuation apparatus which includes one or more elongated perforated flow tubes attached to a header, the tubes serving to attenuate or silence noises from fluid streams passed therethrough. In addition, the present invention relates to a unique and novel method for forming a sound attenuating apparatus.

A number of types of sound attenuating or silencer devices of unitary construction are known in the art to accommodate for different sizes and differing number of tubes in accordance with the fluid borne noises to be treated. Many of these devices have required numerous and expensive parts and have been complicated and costly in the manufacture and assembly, often requiring a considerable number of tools, some of which have proven to be expensive and limited in use.

The broad silencer arrangement employing an insulated duct or tube with perforated inner walls has been long known in the art, as can be seen in the long since expired U.S. Pat. No. 2,489,048, issued to E. Rinehart on Nov. 22, 1949. A similar insulated duct type arrangement also is disclosed in Japanese patent No. 52-5455, issued to Kinichiro Asami on May 2, 1977. Attention is further directed to expired U.S. Pat. No. 3,019,850, issued to J. J. March on Feb. 6, 1962, which also teaches a prefabricated, insulated duct having perforated, hinged and joined wall portions which can be readily assembled by pivoting the hinged portions into end-to-end abutting relation and then heating thermosetting plastic to join the abutting end portions. Attention finally is directed to U.S. Pat. No. 4,127,183, issued to Tom E. McLarty on Nov. 28, 1978, which teaches a plurality of separate perforated flow tubes mounted on flanges of a header provided with upstream V-shaped inlet flanges.

Although these several aforementioned references of the prior art teach broad embodiments of individual sound attenuating perforated tube members mounted in a flow through housing with particular construction structures and gas flow entrances, none teaches the novel and unique apparatus and method herein disclosed wherein a novel sound attenuating structure is provided that is particularly suited for use with fluid streams having high pitched noises created by various sized turbines and compressors operating at very high speeds. The high pitch of these noises can vary from engine to engine, whether manufactured by the same or differing manufacturers. The present invention, recognized the problems presented by such varying high pitch noises created by turbines and compressors which operate at varying high speeds and with differing numbers of blades and rotational speeds, provides a unique arrangement that allows for ready acoustic tuning to match and attenuate noise pitch and, at the same time, reducing the possibility of foreign objects being ingested into the fluid stream with concomitant possible damage to the served engine parts. The present invention not only allows efficient and economical acoustic adjustment and reduced foreign object ingestion, but it also eliminates many of the laborious and inefficient forming and welding practices associated with prior art arrangements. Moreover, the present invention provides a novel method for manufacturing and assembling acoustically tuned sound attenuating assemblies in an efficient and economical manner with a minimum of steps and a minimum of special tuning.

Various other features of the present invention will become obvious to one skilled in the art upon reading the disclosure set forth herein.

BRIEF SUMMARY OF THE INVENTION

More particularly the present invention provides a unique sound attenuating apparatus for fluid stream noises comprising: a flow-through housing including an upstream housing inlet end and spaced downstream housing outlet end; elongated, perforated, shaped wall sheet means extending between the upstream housing inlet end and the spaced housing outlet end to define at least one elongated perforated flow passage for a fluid flow noise to be attenuated; sound attenuating means arranged to surround the elongated perforated wall sheet means defining the flow passage; and, mechanical joining means to join the shaped wall sheet means together outside the fluid passage so as to enhance fluid stream flow and reduce the risk of foreign material ingestion into the noise borne fluid stream. Further, the present invention provides a unique and novel arrangement for packaging fibrous sound attenuating material in sound absorbing cloth enclosures or cases to form easy to handle and assemble sheet-like slabs and strips. In addition, the present invention provides a unique and novel method which utilizes a minimum of steps and materials in forming a sound attenuating housing assembly for attenuating noises in a fluid stream comprising the steps of: forming a plurality of fluid impervious elongated panels for a flow-through housing of preselected size and shape to be joined together along adjacent edges with the joinder outside a fluid passage to be treated when assembled in housing form; placing an elongated first panel of the fluid impervious panels in position to receive a stacked sound attenuating assembly core thereon; stacking a first sound attenuating material slab thereon conforming with the first fluid impervious panel; preparing an elongated perforated first wall sheet conforming with the first slab of sound attenuating material, the wall sheet having preselectively spaced passage defining first perforated wall strip sheets joined along one edge thereof in fast relation on one face of the first perforated wall sheet; stacking the spaced strip sheet joined first wall sheet on the stacked first slab of sound attenuating material with the wall sheet and strip sheet joinder facing the first slab of sound attenuating material; stacking strips of sound attenuating material between preselectively spaced alternate passages between the spaced strip sheets to provide flow-through passages therebetween; stacking a second elongated perforated wall sheet conforming with the first slab of sound attenuating material with one face of the second sheet of perforated material resting On the first strip sheets with each strip sheet joined along the outer edge of the first spaced strip sheets in fast relation to the other face of the second perforated sheet of material; stacking a second conforming sound attenuating material slab on the second elongated perforated sheet to cover the first strip sheet joinders with the second elongated perforated sheet and to substantially surround the first flow passages with sound attenuating material; repeating the stacking sequence aforedescribed until a predetermined stacked core level is reached; and joining the other fluid impervious elongated panels to the first fluid impervious panel to form a housing surrounding the fluid attenuating stack with panel joinders positioned along the outside face of such housing.

It is to be understood that various changes can be made by one skilled in the art in the several parts of the apparatus and the several steps of the method disclosed herein without departing from the scope or spirit of the present invention.

For example, other types of mechanical joinders outside the flow stream could be utilized beside the disclosed slot and tab arrangements, such as nesting, longitudinally extending flanges which are mechanically crimped or clamped together. Moreover, in the disclosed method steps herein, it would be possible to stack the internal sound attenuating core first and then assemble all of the panels of the flow-through housing therearound, or assemble the housing and then place the assembled core therein. Also, various types of acoustically absorbing material could be used or a suitable preselectively sized gap could be provided between perforated sheets to accommodate for ambient air or other selected gas mixtures.

BRIEF DESCRIPTION OF THE DRAWINGS

Referring to the drawings which disclose one advantageous embodiment of the present invention and an advantageous modification thereof.

DETAILED DESCRIPTION OF THE DRAWINGS

Figure 1:
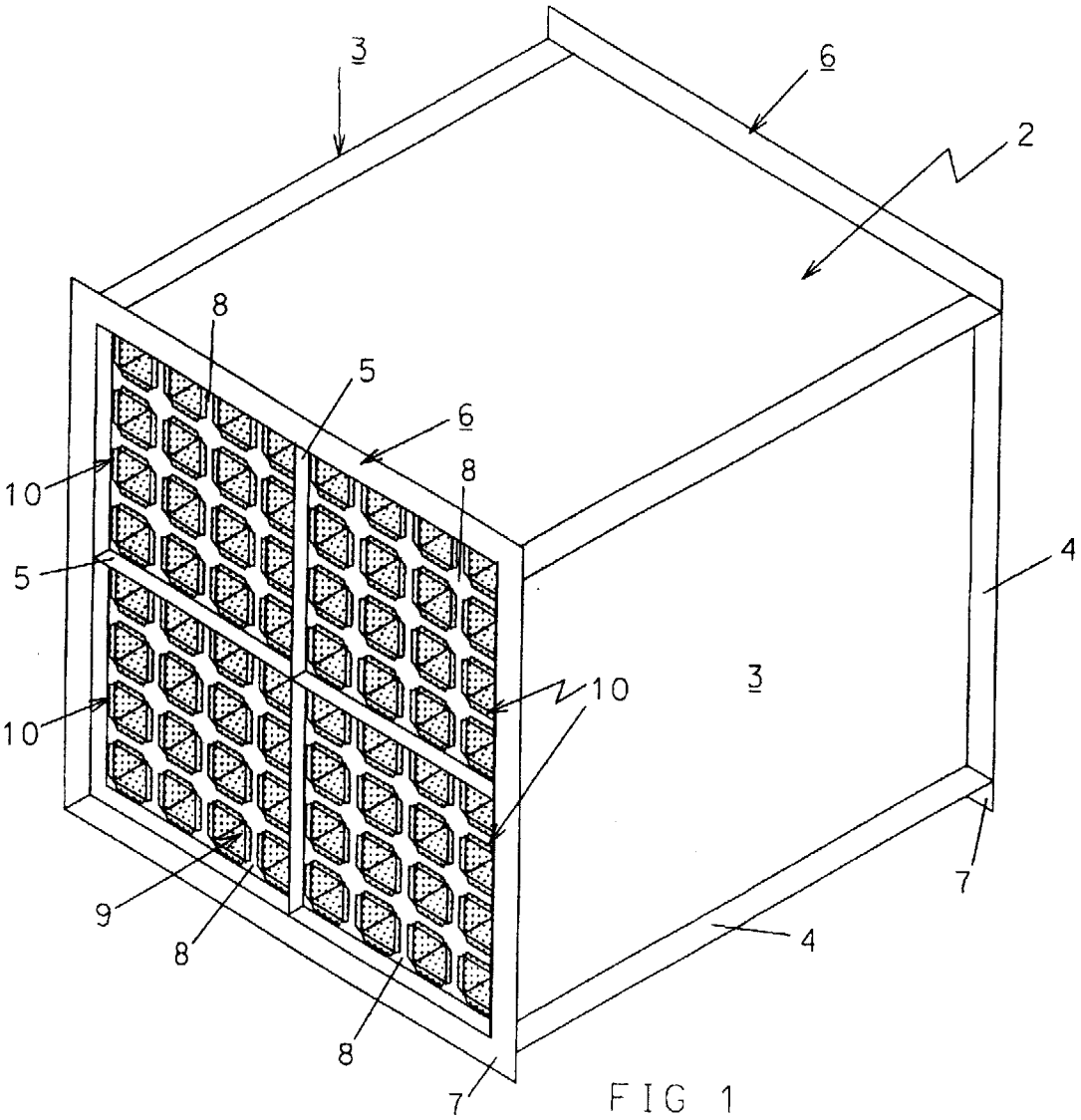
FIG. 1 is an isometric upstream front end view of the novel sound attenuating apparatus for fluid stream noises which incorporates several features of the present invention.
Figure 2:
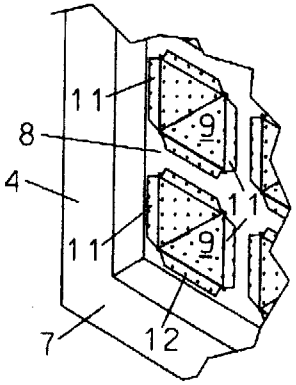
FIG. 2 is an enlarged corner portion of the housing of FIG. 1, disclosing in more detail the novel end tab arrangements for fastening the tube forming perforated sheets and associated perforated strips to a header.

Referring to FIGS. 1 and 2 of the drawings, a flow-through housing 2 is disclosed as including four rectangular panels formed from a suitable fluid impervious material such as stainless steel, galvanized iron or other suitably selected materials, as the noise attenuating occasion might indicate. It is to be noted that each of side panels 3, (only one of which can be fully seen in FIG. 1) is provided with a suitable edge flange 4 which extends normally therearound from the outer face of the panel. The front, or upstream panel 6 and the like downstream rear panel which also can not be fully seen are each sectioned by cross members 5 to accommodate one of four sound attenuating subcores 10. These panels are so sized that upper and lower edges 7 extend beyond the side panel edges 4 respectively. The utilization of such subcores 10 serves to allow for ease in manufacture and assembly. Each upstream front and downstream rear panel 6 is provided with one of four subcore header sheets 8. It is to be that the four subcore header sheets 8 can be unitarily formed or four separate sheets can be used.

In the embodiment disclosed, each header sheet 8, is shown as including four spaced rows of openings or passages 9, with each row including four spaced openings or passages so as to provide a total of sixteen openings or passages for each subcore to be in communication with a fluid stream passing through a like number of perforated, elongated subcore passages hereinafter described. It further is to be understood that the present invention should not be considered as limited to the particular housing shapes, subcore sections and subcore passages of sizes, numbers and shapes as a disclosed in FIG. 1, but that other shapes, numbers and sizes can be utilized in accordance with the environment and noise attenuating demands to be met. It also is to be noted and, as can be particularly understood from the enlarged. FIG. 2 of the drawings, each header sheet 8, as shown in FIG. 1 of the drawings, has its sixteen passages 9, each connected with a communicating elongated, perforated subcore flow-through passage to be described more fully hereinafter. This connection is accomplished by means of two spaced and opposed vertical tabs 11 and two spaced and opposed horizontal tabs 12. These tabs which are an integral part of a subcore, are turned to engage the outer face of a header so as to be fully out of a fluid stream, the noises of which are to be attenuated.

Figure 3:
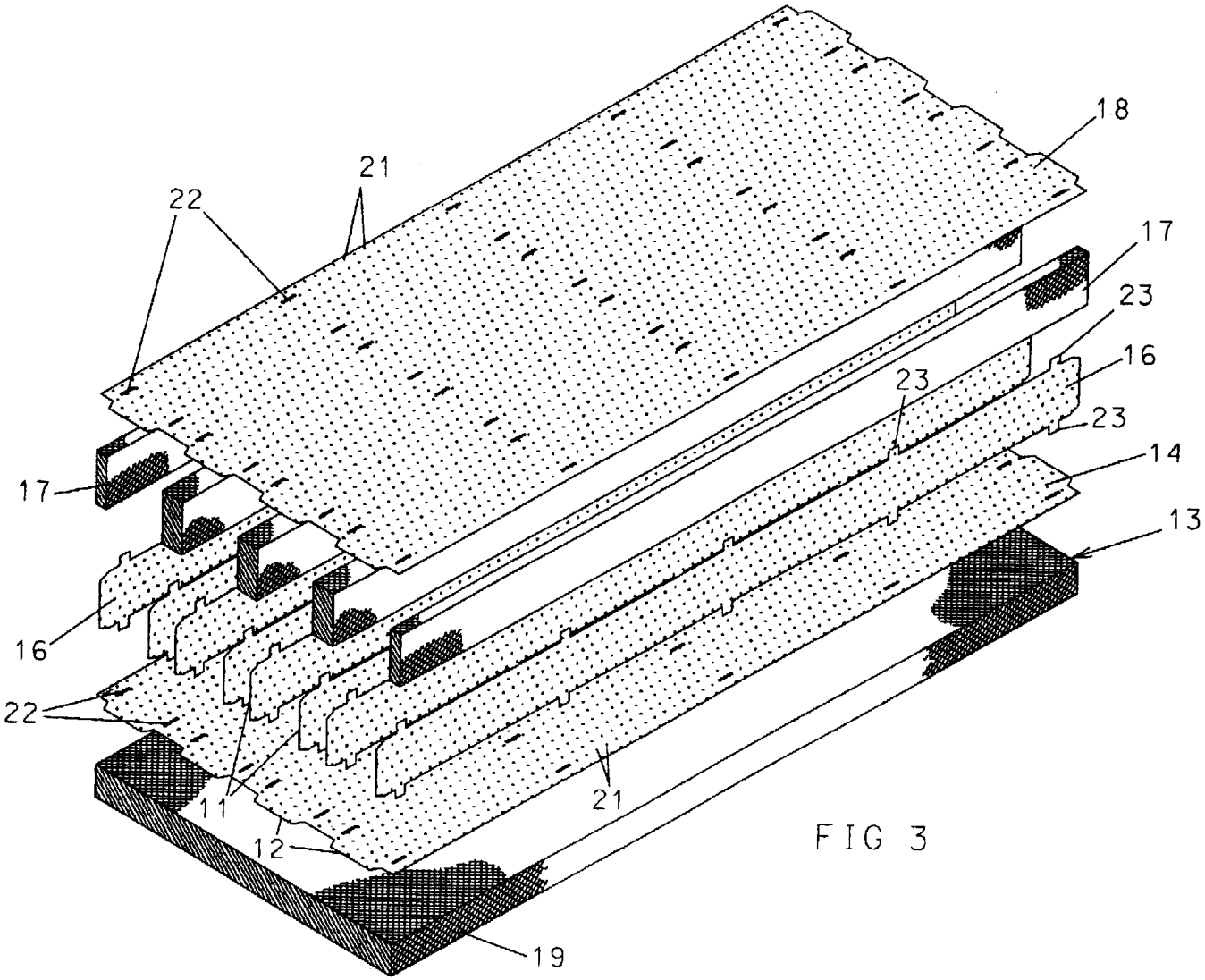
FIG. 3 is an enlarged, exploded, isometric portion of one stacked level of the sub core of the housing of FIG. 1, disclosing details of a slab sheet of sound attenuating materials, a pair of spaced slotted, elongated perforated sheets and a plurality of spaced elongated perforated strips and spaced elongated pillow-like sound attenuating material strips selectively inserted in alternative elongated passages between the perforated strips sheets.
Figure 4:
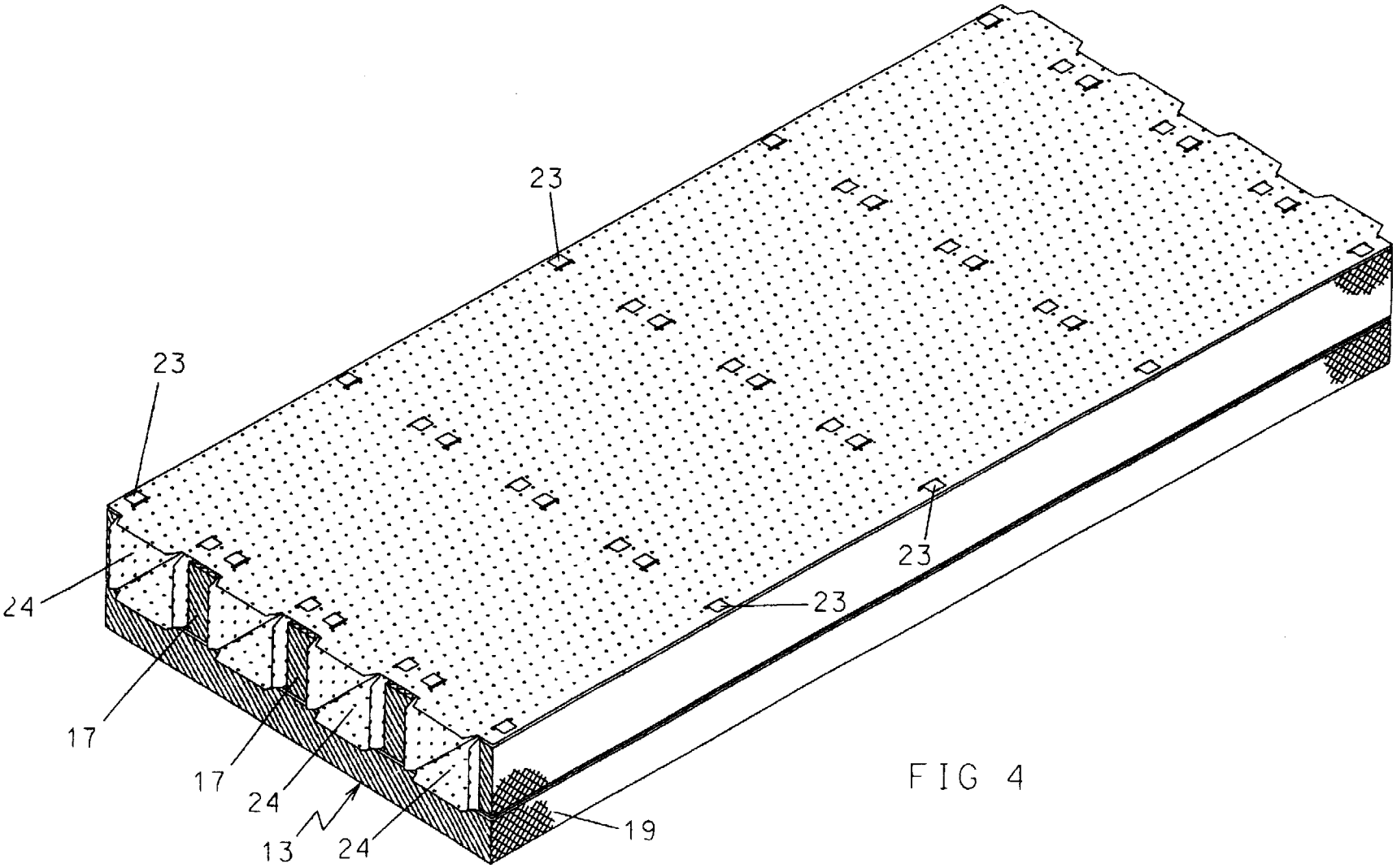
FIG. 4 is an enlarged isometric view of the assembled stack portion of FIG. 3.

Referring to FIGS. 3 and 4 of the drawings there is disclosed in exploded and assembled views respectively, one of the novel subcores 10 to be assembled in elongated stacked relation in flow-through housing 2. Viewing these figures from the bottom up, the several parts of a subcore 10 include an elongated sound attenuating slab 13, an elongated, perforated sheet 14, preselectively spaced, elongated, perforated strip sheets 16, preselectively spaced elongated sound attenuating material strips 17 and another like elongated perforated sheet 18.

Sound attenuating slab 13 and sound attenuating strips 17, can be formed from a selected fibrous material, such as a preselected mineral wool. One such sound attenuating mineral wool is sold by the U.S. Gypsum Co. under the trade name "Thermafiber". The sound attenuating slab 13 and sound attenuating strips 17 are of a preselected size and shape as determined by the size of flow-through housing 2 and the header sheets 8 and each slab and strip can be enveloped by a suitable noise pervious jacket or casing such as glass cloth No. 1675 sold by Burlington Industries.

The elongated, first and second, perforated sheets 14 and 18 and the plurality of strip sheets 16 can each be formed from a suitably selected thin metallic or other appropriate material and can be of a material like that used for the panels of noise impervious housing 2, but only thinner and lighter in nature. Each elongated perforated sheet 14 and 18 and strip sheet 16 is punched or otherwise formed to include a plurality of spaced rows of holes 21. The size and arrangement of the holes 21 can vary, depending upon the nature and pitch of the noises to be attenuated. In one advantageous embodiment of the invention, the holes can be three thirty seconds of an inch (3/32") in diameter with staggered centers of three sixteenths of an inch (3/16") to provide open areas of approximately twenty three (23) percent. In addition to the perforated holes 21, each elongated sheet 14 and 18 is provided with preselectively spaced rows of spaced punched or otherwise formed slits 22. These spaced rows of spaced slits serve to receive spaced tabs 23 integrally formed along opposite, longitudinal edges of perforated strip sheets 16. As aforedescribed, the opposite longitudinal ends of each elongated perforated sheet 14 and 18 and elongated perforated strip sheets 16 are also provided with integral oppositely facing pairs of opposed horizontal and vertical tab portions, each of the pair of opposite tabs 11 on strips 16 serving as vertical tabs and each of the pair of opposed tabs 12 serving as horizontal tabs. In the manner aforedescribed for FIGS. 1 and 2, each pair of opposed tabs are arranged to engage with a communicating passage in header sheets 8 to be turned in faced relation to the outside face of the header sheet 8 and turned away from the fluid stream to be treated. In this regard, it is to be noted that the tabs 23 engage with slits 22 to be turned away and in facing relation to elongated perforated sheet 14 on that face which faces slab 13. It further is to be noted that the spacing of the rows of spaced slits 22 is such that when tabs 23 are so engaged and turned, spaced elongated, perforated flow passages 24, each communicate with two aligned passages 9 in upstream and downstream header sheets 8 with the elongated sound attenuating strips 17 being positioned in the alternative spaces on either side of the perforated passages 24. Thus, each passage is fully surrounded by sound attenuating material when the lower sound attenuating slab 13 of the next stack of the subcore is stacked on the second elongated perforated sheet 18 with spaced tabs 23 on the upper edge of each perforated sheet strip 16 being turned to abut second attenuating slab 13 of the next like stack.

In accordance with the novel method of the present invention, the following steps are included. First, forming a plurality of fluid impervious elongated panels for a flow-through housing, such as aforesaid housing 2. These panels ar formed in a preselected size and shape so as to be joined together along adjacent edges outside of a fluid passage to be treated when they are assembled as a flow through house. A subcore to fill the flow-through housing can be formed by either placing a side panel in an appropriate position to receive the subcore stack before the flow-through housing is formed or by forming the housing first and then forming the subcore. In forming the subcore the sequence of forming substantially can follow the sequence of stacking as disclosed in the drawings, which includes stacking a first slab of sound attenuating material such as slab 13, then placing a sheet of elongated, perforated and spaced slit sheet of material thereon, such as first sheet 14, onto the slab. Elongated perforated strip sheets, such as 16, can be assembled to the perforated sheet prior to stacking the same on the sound attenuating slab so that tabs on the lower edge of the strips can be turned on the elongated perforated sheet to face the sound attenuating slab. The elongated, perforated strips are So spaced on the elongated perforated sheet to form spaced elongated perforated rows of flow passages. Sound attenuating strips, like strips 17, can then be positioned in alternate spaces formed by the elongated perforated strip sheets 16 so that each side wall of each flow-through passage is surrounded by sound attenuating material as is the bottom walls of such passages by the first elongated sound attenuating sheet and elongated sound attenuating slab positioned therebelow. A second elongated perforated and spaced slit sheet, like sheet 18, is then placed on the stack with the tabs of the spaced, perforated strip sheets engaging in the spaced punched slits 22 of the second elongated perforated sheet end being turned and with the second sound attenuating slab 13 of the next similarly sequenced layers serving to provide an upper elongated, perforated sound attenuating wall for the flow-through passages therebelow.

Figures 5, 6, 7:
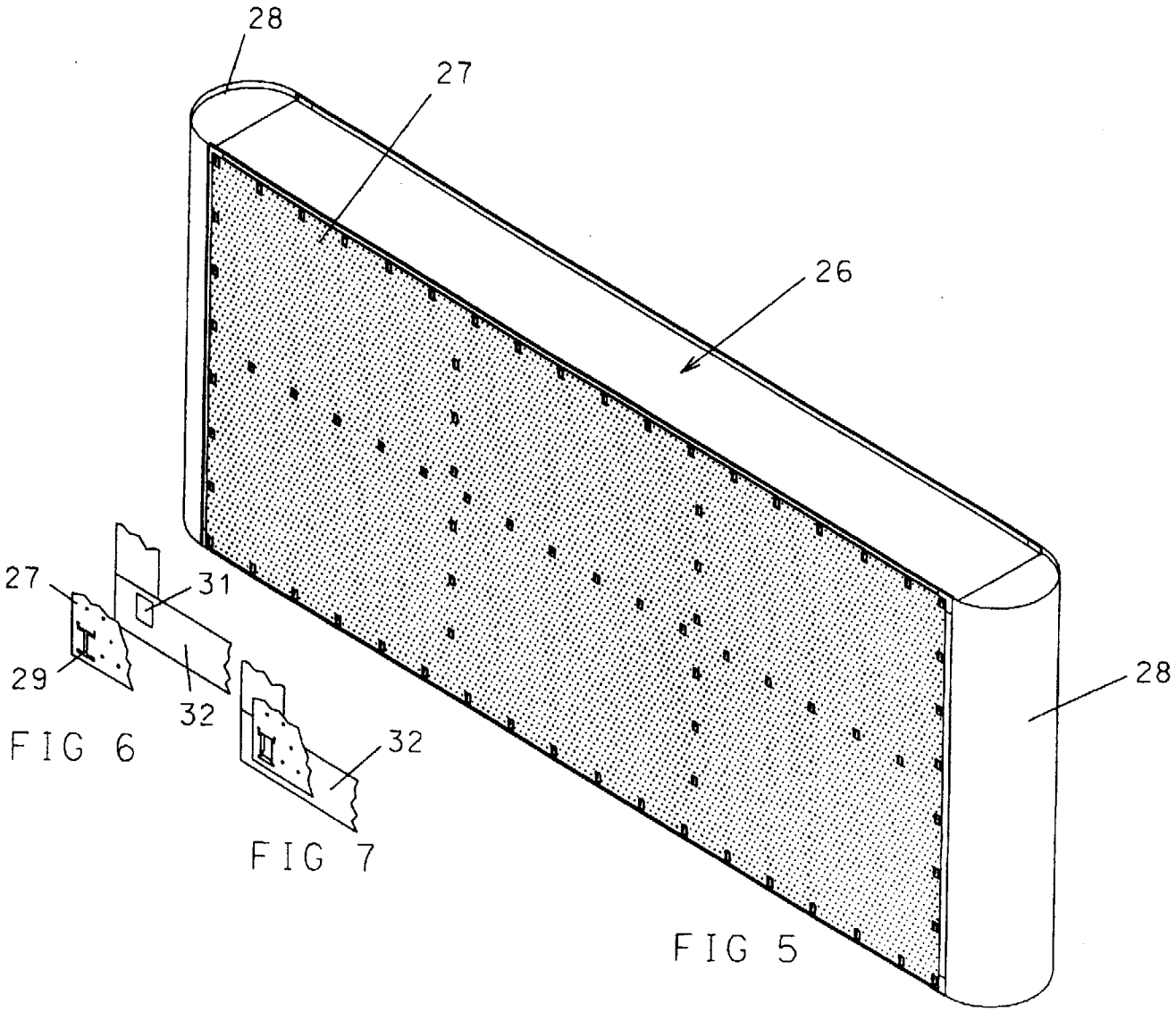
FIG. 5 is an isometric view of a modified embodiment of the present invention.
FIG. 6 is an enlarged, exploded isometric view of a portion of the elongated perforated sheet of FIG. 5 and the support frame, disclosing still another novel slot and tab arrangement; and, FIG. 7 is an assembled view of the exploded structure of FIG. 6.

As can be seen in FIG. 5 of the drawings, a further advantageous perforated wall embodiment of the present invention is disclosed. In this embodiment of the invention, which embodiment is particularly adapted for use with very large gas turbines and very large compressors, sound attenuating elongated walls 26, such as disclosed, can be mounted in an appropriate housing frame similar to that of housing 2 with the elongated, perforated walls being spaced to form flow-through passages therebetween. Each sound attenuating elongated perforated wall can be similar to that aforedescribed so as to include spaced, elongated, perforated sheets of materials 27 similar to sheets 14 and 18. These sheets 27 are spaced from each other on the housing frame to include one or more slabs of sound attenuating material similar to the aforedescribed encased sound attenuating slabs 13 and strips 17. One of the unique features of this embodiment of the invention, is that each wall includes upstream and downstream longitudinally extending curvilinear, semi-circular in cross-section, fluid impervious sheets of material 28. These curved sheets serve to guide the noise bearing fluid stream, increasing the velocity and reducing the pressure of fluid streams passing through the flow-through passages formed by spaced sound attenuating, perforated and elongated spaced walls 26. A unique feature of this disclosed wall of FIG. 5 is the tab and slot arrangement disclosed more fully in FIGS. 6 and 7 of the drawings. In these respectively exploded and assembled figures, an H-shaped opposed tab arrangement 29 is shown as punched or otherwise formed at a corner of elongated perforated sheet 27 and an appropriately sized slot 31 is punched or otherwise formed at the corner of frame 32. Opposed tabs 29 of the H shaped arrangement are turned from perforated sheet 27, extended through mating slot 31 in frame 32 and turned to engage that face of frame 32 outside the flow-through path of a fluid stream to be treated. It is to be understood that the perforated, elongated wall 26 as aforedescribed can be of varying length and spacing and can be formed in longitudinally adjacent and abutting sections similar to the sectional formation of FIGS. 1–4, all in accordance with sound attenuating conditions to be met.

The invention claimed is:

1. A sound attenuating apparatus for noise bearing fluid streams comprising: a flow through housing including an upstream housing inlet end and a spaced downstream housing outlet end;

elongated, perforated, shaped wall sheet means extending between said spaced upstream housing inlet and outlet ends, said wall sheet means being shaped to define at least one elongated perforated fluid flow-through passage for said noise bearing fluid stream to be attenuated;

sound attenuating means arranged to surround said elongated perforated wall sheet means defining said fluid flow-through passage;

and mechanical joining means including integral tab and slot means to join said shaped wall sheet means together outside said fluid flow-through passage to enhance noise bearing attenuation in a fluid stream flow and to reduce the risk of foreign materials ingestion.

2. The sound attenuating apparatus of claim 1, said mechanical joining means being an integral part of said wall sheet means.

3. The sound attenuating apparatus of claim 1, said elongated perforated wall sheet means comprising at least three spaced elongated perforated sheets joined along adjacent edges outside said fluid flow-through passage by said mechanical joining means to form said elongated perforated flow-through passage of preselected open cross-sectional shape.

4. The sound attenuating apparatus of claim 1, said elongated perforated wall sheet means comprising at least two pairs of elongated perforated spaced sheets joined along adjacent edges by said joining means to form said elongated perforated flow passage of open, parallelogram cross-sectional shape.

5. The sound attenuating apparatus of claim 1, said sound attenuating means arranged to surround said elongated perforated wall sheet means defining said at least one flow-through passage comprising a preselectively sized gap.

6. The sound attenuating apparatus of claim 1, said sound attenuating means arranged to surround said at least one elongated perforated wall sheet means defining said fluid flow-through passage comprising slabs and strips of elongated sound attenuating pillow-like walls of fibrous material encased in elongated sound pervious pillow-like cloth cases.

7. The sound attenuating apparatus of claim 1, said elongated perforated wall sheet means comprising a plurality of elongated perforated, spaced sheets extending in spaced parallel relation between said upstream housing inlet end and said spaced downstream housing outlet end, each of said perforated sheets having spaced rows of spaced slits, a plurality of spaced elongated perforated strip sheets extending in spaced parallel relation between and substantially normal to said spaced elongated perforated sheets, each of said perforated strip sheets being provided with spaced turnable tab members along opposite edges thereof to engage in said spaced rows of spaced slits in said spaced parallel sheets to define spaced elongated perforated flow-through passages of rectangular-like cross-section with alternative passages to accommodate said sound attenuating material.

8. The sound attenuating apparatus of claim 7, said sound attenuating material arranged to surround said elongated perforated all sheet means defining said elongated flow passages comprising elongated sound attenuating pillow-like walls of fibrous material encased in elongated sound pervious pillow-like cloth cases, said encased pillow-like walls being in the form of elongated pillow-like slabs and elongated pillow-like strips with said pillow-like strips longitudinally extending in those spaces between each row of spaced side-by-side elongated perforated flow-through passages and the slabs extending between spaced elongated perforated sheets to be in surrounding relation to such elongated flow-through passages.

9. The sound attenuating apparatus of claim 7, including header sheet means mounted to said housing to provide a fluid passage communicable with said elongated perforated flow-through passage, and joining means to join together the extremities of said perforated wall sheets to said header sheet means outside said communicating fluid passage to further enhance fluid stream flow and reduce the risk of foreign materials ingestion.

10. The sound attenuating apparatus of claim 9, said elongated perforated sheets and elongated perforated strips having upstream and downstream turnable tabs respectively engageable in said header passages to be turned and joined to said headers outside said flow-through fluid passages.

11. The sound attenuating apparatus of claim 9, said header sheet means including a pair of spaced header sheets mounted at said spaced upstream inlet end and downstream outlet end of said housing, each sheet having an equal number of aligned passages; said perforated wall sheet means including a plurality of perforated sheets defining a plurality of elongated perforated passages each with opposite ends connected to said aligned passages in said spaced header sheets with joining means outside said fluid passages and with sound attenuating material surrounding said elongated perforated passages.

12. The sound attenuating apparatus of claim 9, said header sheet means including spaced header sheets mounted at said spaced upstream inlet end and downstream outlet end of said housing, each upstream and downstream header having an equal number of spaced aligned rectangular-like shaped passages corresponding in cross-section and communicating with said elongated perforated flow passages also of rectangular-like shaped cross-section between said spaced header sheets.

13. The sound attenuating apparatus of claim 9, said header sheet means including spaced elongated curvilinear, fluid impervious sheets mounted to said housing upstream said elongated perforated flow passage to provide an, inwardly tapering inlet into said elongated perforated flow passage.

14. The sound attenuating apparatus of claim 13, said joining means including slot and tab joining arrangements between said header sheet means and said wall sheet means with each slot on one of said means cooperatively positioned to be fastened to a pair of tabs formed in and turned away from an H-type formed section in the other of said means.

15. A sound attenuating apparatus for noise bearing fluid streams comprising: a flow-through fluid impervious housing constructed of steel panels to include an upstream housing inlet end and a spaced downstream outlet end; a pair of upstream and downstream headers having spaced rows of spaced aligned flow-through passages therein; elongated, perforated steel sheets extending in parallel relation between said upstream inlet end and said downstream outlet end of said housing, each of said parallel, elongated sheets including a plurality of spaced rows of three-thirty seconds of an inch diameter spaced perforations with the perforation of adjacent rows being in staggered relation and with the centers of said perforations being spaced from each other three sixteenths of an inch, each strip sheet having a row of spaced aligned integral tab members on opposite edges thereof to engage in a row of opposed spaced slits in spaced adjacent parallel elongated perforated sheets, the tabs being turned in fast facing relation to the opposite face of each spaced parallel, elongated sheet with said spaced, elongated, perforated strip sheet walls defining elongated spaces therebetween to provide perforated walls which define spaced elongated perforated flow-through passages; therebetween communicating with said aligned passages a said upstream and downstream headers, said elongated perforated sheets and said engaging perforated strip sheets each having tab portions of opposite extremities thereof engaging with said aligned passages in said headers which tab portions are turned to engage the faces of said headers away from the flow stream passages; a plurality of spaced elongated, sound attenuating strips engaging in the alternate spaces of said spaced fastened perforated strip sheets to provide sound attenuating material for said perforated wall defined, flow-through passages; a plurality of elongates spaced sound attenuating slabs, each facing an elongated perforated sheet so as to surround said elongated flow passages with sound attenuating material on the four perforated walls of each flow through passage; each of said sound attenuating slabs and strips being comprised of glass cloth encased mineral wall.

* * * * *